US005934120A

United States Patent [19]

Kuo

[11] Patent Number: 5,934,120

[45] Date of Patent: Aug. 10, 1999

[54] LOCK WITH A RESETTABLE COMBINATION

[76] Inventor: Lambert Kuo, No. 16, La. 459, Sec. 1, An Ho Rd., Tainan, Taiwan

[21] Appl. No.: 09/001,212

[22] Filed: Dec. 30, 1997

[30] Foreign Application Priority Data

Dec. 5, 1997 [TW] Taiwan ..... 86220272

[51] Int. Cl.[6] ..... E05B 37/02

[52] U.S. Cl. ..... 70/312; 70/30; 70/316; 70/DIG. 44

[58] Field of Search ..... 70/30, 312, 316, 70/317, 318, 323, 324, DIG. 21, DIG. 44, 315, 26

[56] References Cited

U.S. PATENT DOCUMENTS

| | | | |
|---|---|---|---|
| 4,341,101 | 7/1982 | Bako | 70/312 |
| 5,027,623 | 7/1991 | Ling | 70/318 |
| 5,235,831 | 8/1993 | Lauria et al. | 70/312 |
| 5,636,539 | 6/1997 | Tsai | 70/312 |
| 5,653,136 | 8/1997 | Huang | 70/312 |

*Primary Examiner*—Darnell M. Boucher
*Attorney, Agent, or Firm*—Patterson & Keough, P.A.

[57] ABSTRACT

A lock with a resettable combination includes a locating head having a tube extending therefrom and a locking head having a rod extending therefrom and receivably engaged with the tube. A spring, a set of selectors and a sequence reset device are respectively and sequentially mounted around the tube of the locating head. Each of said plurality of selectors having a rotatable ring, a locating block, a drive block and a torsion spring combined for selection. The sequence reset device includes an annular member and a toggle device for driving the set of selectors. The annular member defines a pair of opposed holes in a periphery thereof. The toggle device is pivotally engaged with the annular member and configured as a semi-circular collar. The semi-circular collar has a pair of cam gears respectively formed on two distal ends defined therein. Each of the pair of cam gears extends through a corresponding one of the pair of opposed holes of the annular member and defines a large-diameter end and a small-diameter end. The large-diameter end and the small-diameter end selectively abut the respective selector when the toggle device is pivoted with respect to the annular member.

9 Claims, 6 Drawing Sheets

LOCK WITH A RESETTABLE COMBINATION

BACKGROUND OF THE INVENTION

1. Field of the Invention

The present invention relates to a lock, and more particularly to a lock with a resettable combination, the resetting operation of which can be readily performed.

2. Description of Related Art

In general, there are various kinds of locks used on motorcycles and bicycles, such as a U-shaped lock, a cable lock and so on. Since the cable lock has a flexible construction and a convenient operation, it is popularly used by many riders. A conventional cable lock has a locking head and tapered end respectively coupled with corresponding end of a cable. The locking head defines a locking hole therein. The tapered end can be snappingly received in the locking hole to achieve a locking state. When the cable lock is to be unlocked, a user may use a key to open the cable lock. This kind of cable lock has a disadvantage that the cable lock can not be unlocked if the user loses the key. For this reason, a kind of combination cable lock has been developed. The combination cable lock can be locked and unlocked by adjusting a set of symbol provided thereon, without using a key. However, the existing lock has a drawback that an unlocking sequence of symbols of the lock are preset by the manufacturer and generally can not be changed. As a result, the security effect will fail if the unlocking sequence of symbols is known by a person other than the user. Therefore, a variety of forms of lock with a sequence reset function were developed to overcome the drawback as mentioned above.

FIG. 8 shows a sequence reset means provided in a conventional lock. The lock typically includes an extension means having a locating head and a locking head respectively coupled with two different ends thereof. The locating head has a tube extending therefrom. The locking head has a rod extending therefrom and receivably engaged with the tube. The lock further includes a spring and a set of selectors respectively and subseqentially mounted around the tube of the locating head. Each of the plurality of selectors has a rotatable ring with symbols, such as numerals marked thereon, a locating block, a drive block and a torsion spring combined for symbol selection. A drive plate 80 is rotatably mounted around the tube of the locating block. The drive plate 80 has a tongue 81 formed thereon which is operable to shift the locating blocks of the set of selectors. Then the sequence reset operation can be performed when the locating blocks are separated from the rotatable rings of the selectors. However, this method to reset the sequence of the lock need to use a tool to operate the tongue 81.

FIG. 9 shows an alternative conventional lock with sequence reset function. The lock utilizes a knob 91 to drive a set of selectors 90. The knob 91 has a tapered block 911 formed therein. When the knob 91 is operated, the tapered block 911 will abut and urge the selector 90 to separate a locating block 901 from a rotatable ring 902 thereof, whereby the rotatable ring 902 can be operated alone and adjusted to a desired position. After the adjustment of the rotatable ring 902, the locating block 901 can be engaged with the rotatable ring 902 again by turning the knob 91 to its initial position. Therefore, the lock can be locked and unlocked under control of a new sequence different to an original one preset by the manufacturer. However, this kind of lock has a disadvantage that the knob 902 may be operated accidentally due to its configuration.

The present invention provides an improved lock with sequence reset function to mitigate and/or obviate the aforementioned problems.

SUMMARY OF THE INVENTION

One object of the present invention is to provide a lock with a resettable combination, the operation of which can be readily performed. It is to be appreciated that any variety of symbols may be used in indicating a combination sequence, however, hereafter the symbols preferred are numbers.

In accordance with one aspect of the present invention, a lock with a resettable combination sequence includes a locating head having a tube extending therefrom and a locking head having a rod extending therefrom and receivably engaged with the tube. A spring, a set of selectors and a sequence reset means are respectively and subseqentially mounted around the tube of the locating head. Each of said plurality of selector have a rotatable ring, a locating block, a drive block and a torsion spring cooperated for sequence selection. Each rotatable ring has a series of numbers marked on an outer circumference thereof. The sequence reset means includes an annular member and a toggle means for driving the set of selectors. The annular member defines a pair of opposed holes in a periphery thereof. The toggle means is pivotally engaged with the annular member and configured as a semi-circular collar. The semi-circular collar has a pair of cam gears respectively formed on two distal ends defined therein. Each of the pair of cam gears extends through a corresponding one of the pair of opposed holes of the annular member and defines a large-diameter end and a small-diameter end. The large-diameter end and the small-diameter end selectively abut the respective selector when the toggle means is pivoted with respect to the annular member.

Other objects, advantages and novel features of the invention will become more apparent from the following detailed description when taken in conjunction with the accompanying drawings.

DETAILED DESCRIPTION OF PREFERRED EMBODIMENT

Figure 1:
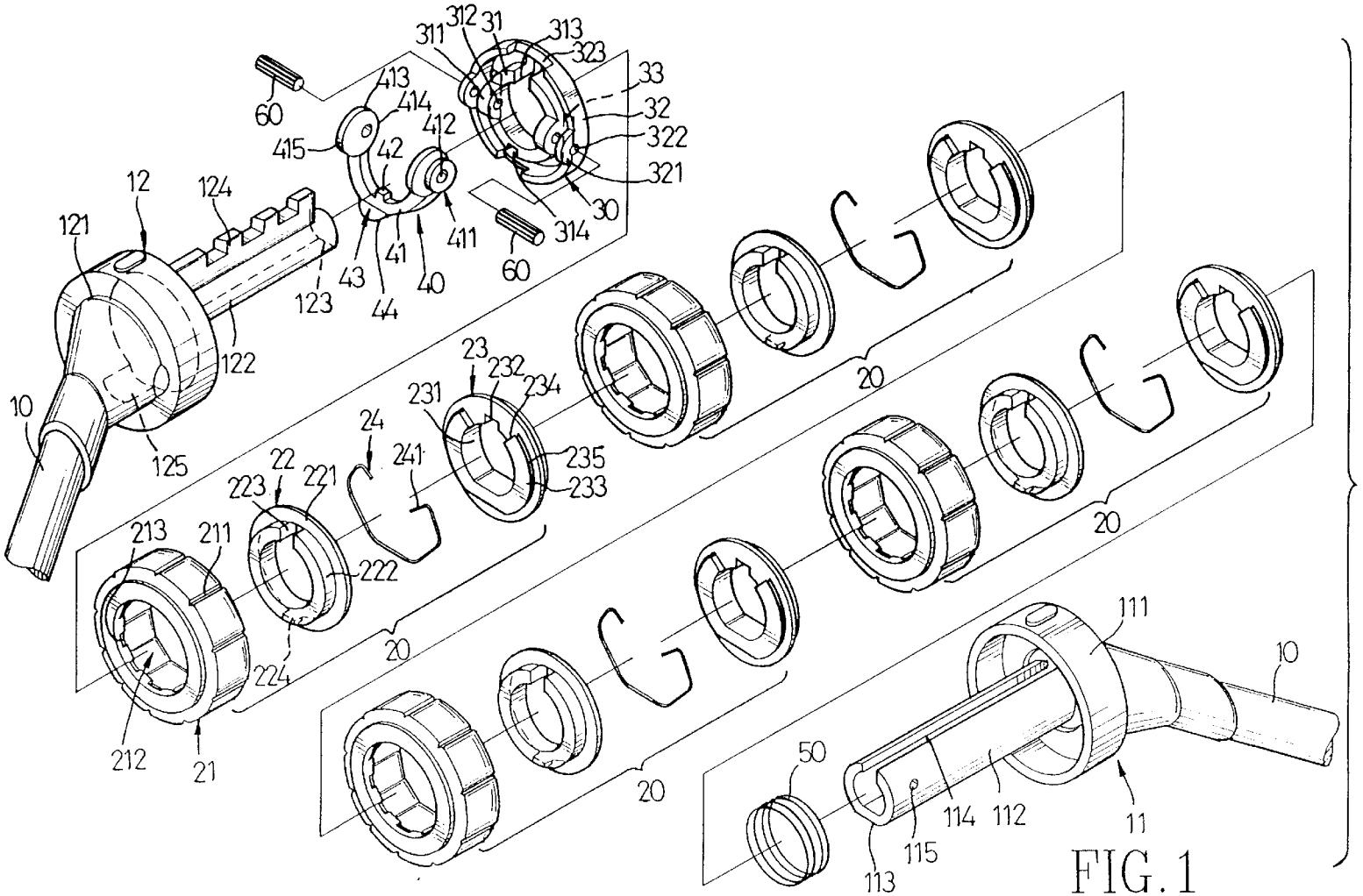
FIG. 1 is an exploded perspective view showing a lock with a resettable combination in accordance with the present invention.
Figure 2:
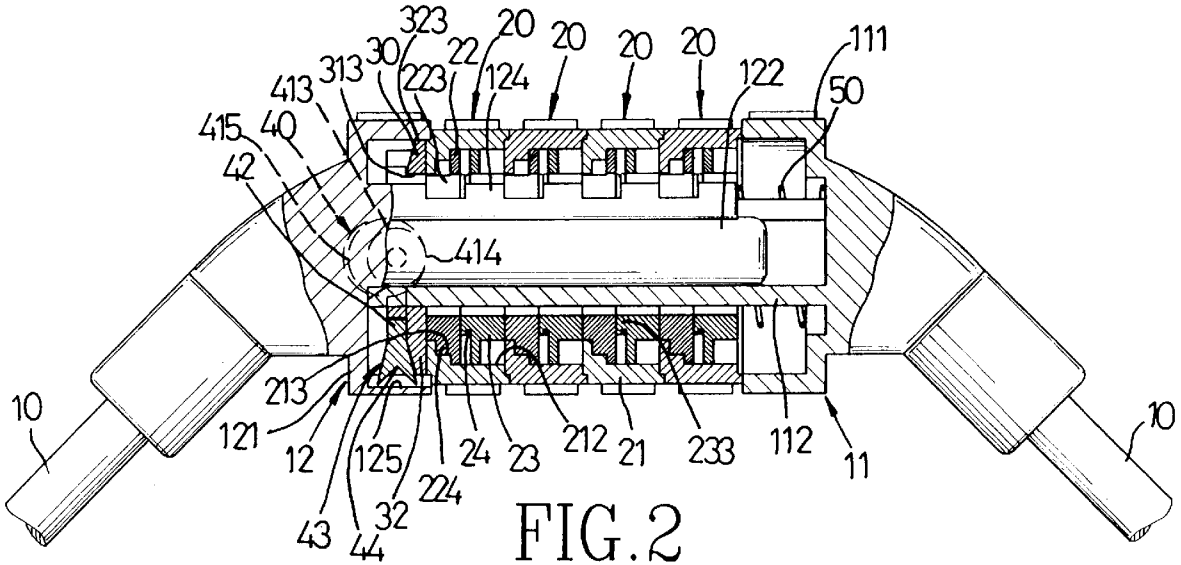
FIG. 2 is a sectional view showing a combined structure of the lock in accordance with the present invention.

Referring to FIG. 1 and FIG. 2, a lock with a resettable combination constructed in accordance with the present invention includes a cable 10, and a locating head 11 and a locking head 12 respectively mounted to two different ends of the cable 10. The locating head 11 has a ring stop 111 and a tube 112 extending from a center of the ring stop 111. The tube 112 has a flat portion 113 formed on a lowest portion of a periphery thereof and an axial slot 114 defined in a top portion of the periphery. The tube 112 further has a pair of opposed orifices 115 defined in the periphery and at two sides of the slot 114. The locking head 12 also has a ring stop 121 and a rod 122 extending from a center thereof. The ring stop 121 has an arcuate recess 125 defined in an inner periphery thereof. The rod 122 is receivably engaged with the tube 112 of the locating head 111 and has a truncated surface 123 formed thereon to mate with the flat portion 113 of the tube 112. A toothed bar 124 integrally extends from the rod 122 and projects from the axial slot 114 of the tube 112 when the locating head 11 is engaged with the locking head 12.

Figure 3:
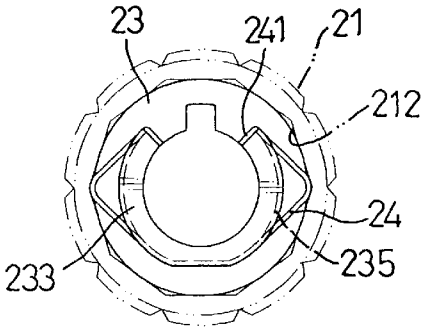
FIG. 3 is a plane view showing a combined structure of a selector in accordance with the present invention.

The lock of this invention further includes a spring 50 and a set of selectors 20 respectively and subseqentially mounted around the tube 112 of the locating head 11. Each of the selectors 20 is composed of a rotatable ring 21 with symbols such as numerals marked thereon, a locating block 22 received in the rotatable ring 21, and a drive block 23 attachedly engaged with the locating block 22. The rotatable ring 21 defines a stepped, polygonal central hole 212 therein. A periphery defining a stepped portion of the central hole 212 has a plurality of valleys 213 defined therein. The rotatable ring 21 further defines a plurality of equi-spaced slits 211 in an outer periphery thereof. The locating block 22 is shaped as a washer 221 with a collar flange 222 extending therefrom. The collar flange 222 is sized to be received in the central hole 212 of the rotatable ring 21. A periphery of the collar flange 222 defines a first gap 223 at a top portion thereof and has a protrusion 224 formed on a lower portion thereof to be received in a respective valley 213 of the rotatable ring 21. The drive block 23 has a central hole 231 defmed therein and a second gap 232 defined in a top portion of a periphery defining the central hole 231. The drive block 23 further has a C-shaped buckle 233 integrally extending therefrom. The C-shaped buckle 233 defines a groove 235 in a periphery thereof to receive a torsion spring 24. The torsion spring 24 has two angled ends 241 respectively gripping two distal ends 234 of the buckle 233 to be prevented from separation from the drive block 23, as shown in FIG. 3.

The lock of this invention further includes a sequence reset means (not numbered) mounted around the tube 112 of the locating head 11 and adjacent to a first one of the set of selectors 20. The sequence reset means includes an annular-member 30 and a toggle means 40. The annular member 30 integrally has an internal ring 31 and an external ring 32. A pair of opposed internal lugs 311 respectively extends from the internal ring 31 at a first side of the annular member 30 and a pair of external lugs 321 corresponding to the pair of internal lugs 311 extends from the external ring 32 at the same side. A connection (not numbered) between each internal lug 311 and a corresponding external lug 321 defines a hole 33 therein. Each of the pair of internal lugs 311 defines a first aperture 312 therein and each of the pair of external lugs 321 defines a second aperture 322 to align with the respective first aperture 312. Further, the internal ring 31 defines a third gap 313 at an upper portion thereof and a recess 314 at a lower portion thereof A periphery of the external ring 32 has two inclined surfaces 323 respectively formed at an upper portion and a lower portion of the first side of the annular member 30.

The toggle means 40 is mounted at the first side of the annular member 30 for driving the annular member 30. The toggle means 40 is configured as a semi-circular ring 41 with two distal ends. Two fitting portions 411 are respectively formed on the two distal ends defined by the semi-circular ring 41 and received in the holes 33 of the annular member 30 to abut against the collar flange 222 of the locating block 22 of the selector 20. Each of the fitting portions 411 is shaped as a cam gear 413. The cam gear 413 defines a bore 412 therein and has a large-diameter end 415 and a small-diameter end 414. With this arrangement, a pair of pins 60 may respectively and sequentially extend through the second aperture 322 of the external lug 321, the bore 412 of the cam gear 413, the first aperture 312 of the internal lug 321 and the orifice 115 of the tube 112 of the locating head 11, thereby engaging the sequence reset means with the locating head 11. It is to be noted that the toggle means 40 is pivotally engaged with the annular member 30, since the bore 412 of the toggle means 40 has a diameter slightly larger than that of the pin 60. Additionally, the toggle means 40 has a boss 42 formed on an inner periphery thereof and an extension 43 formed on an outer periphery thereof. The extension 43 has two bevel side faces 44 so as to facilitate operation of the user.

To lock the lock, a user may adjust the set of selectors 20 to an unlocking sequence of symbols which has been preset by the manufacturer or the user. At this position, the first gap 223 of the locating block 23, the second gap 232 of the drive block 23 and the third gap 313 of the annular member 30 are aligned with each other and correspond to the slot 114 of the tube 112 of the locating head 11, whereby the rod 122 of the locking head 12 may be inserted into the tube 112 and leave the toothed bar 124 thereof projecting from the slot 114 and be received in the first, second and third gaps 223, 232, 313. Then the lock can be locked in a conventional manner by rotating the rotatable rings 21 of the selectors 20 to a random sequence of symbols. To unlock the lock, the sets of selectors 20 can be relocated to the preset symbols to enable the rod 122 to be pulled out from the tube 112.

Figure 4:
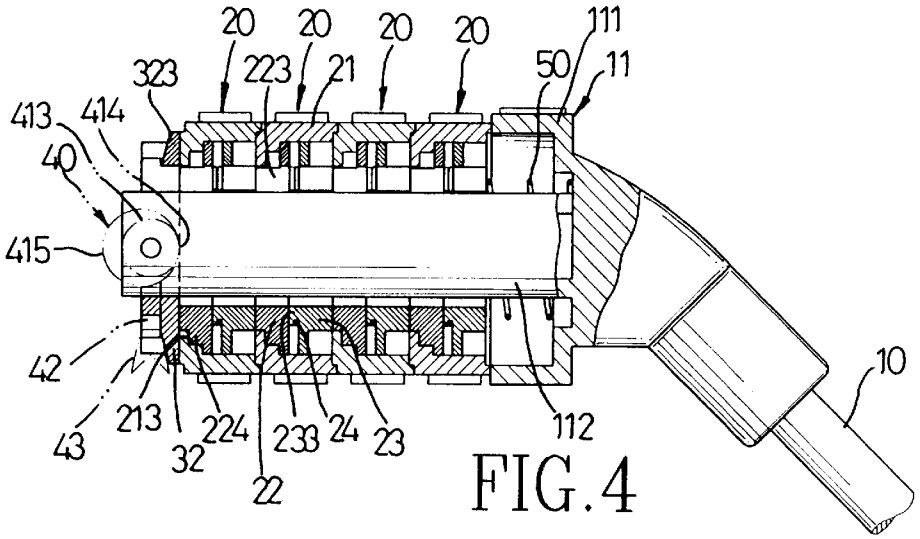
FIG. 4 sectional view showing a combined structure of the lock in accordance with the present invention, wherein a locking head of the lock is removed.
Figure 5:
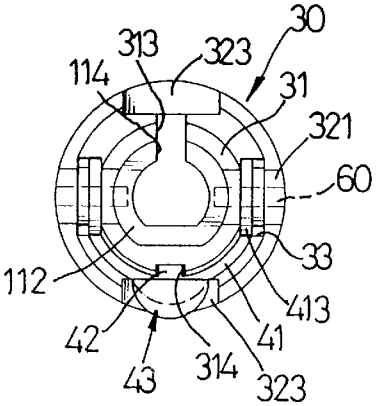
FIG. 5 is a plan view showing the combined structure of the lock of FIG. 4.
Figure 6:
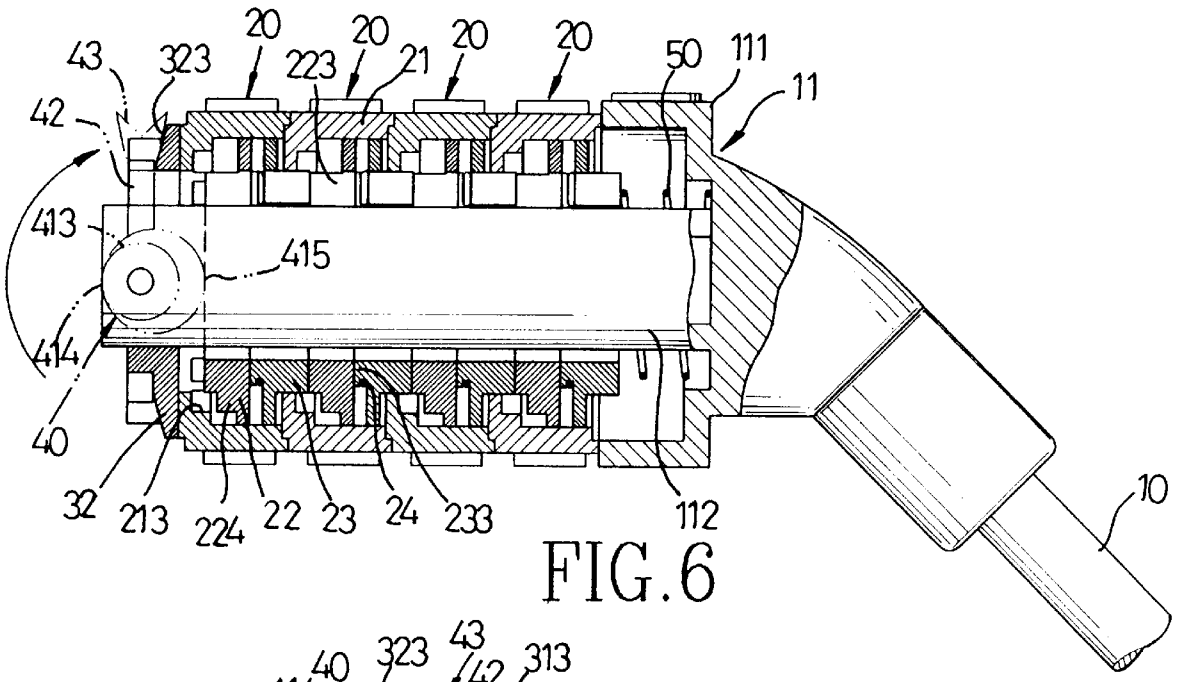
FIG. 6 is a sectional view showing the operation of a number reset member of the lock in accordance with the present invention.
Figure 7:
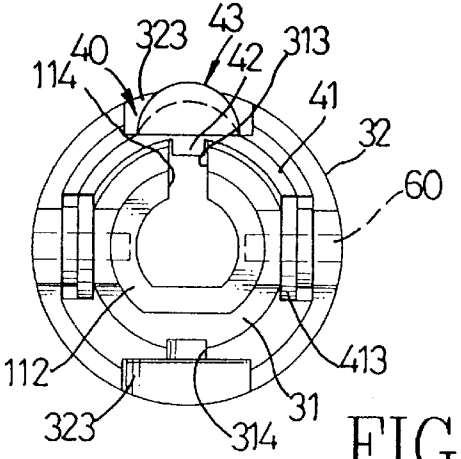
FIG. 7 is a plane view showing the combined structure of the lock of FIG. 4.
Figure 8:
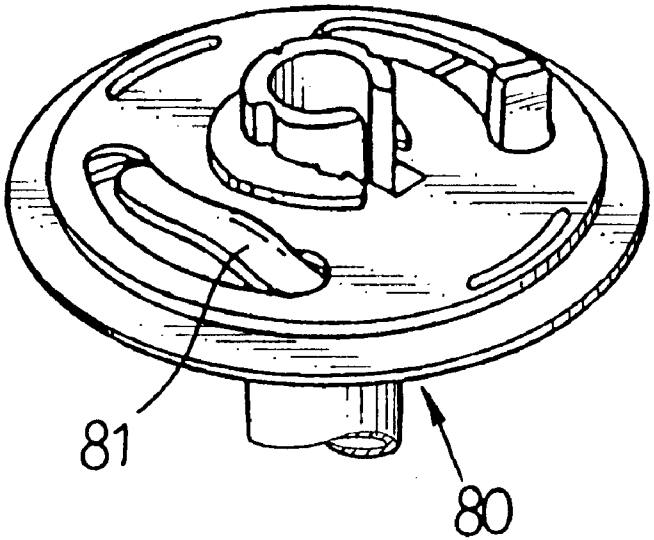
FIG. 8 PRIOR ART
FIG. 8 is a perspective view showing a number reset member of a convention lock.
Figure 9:
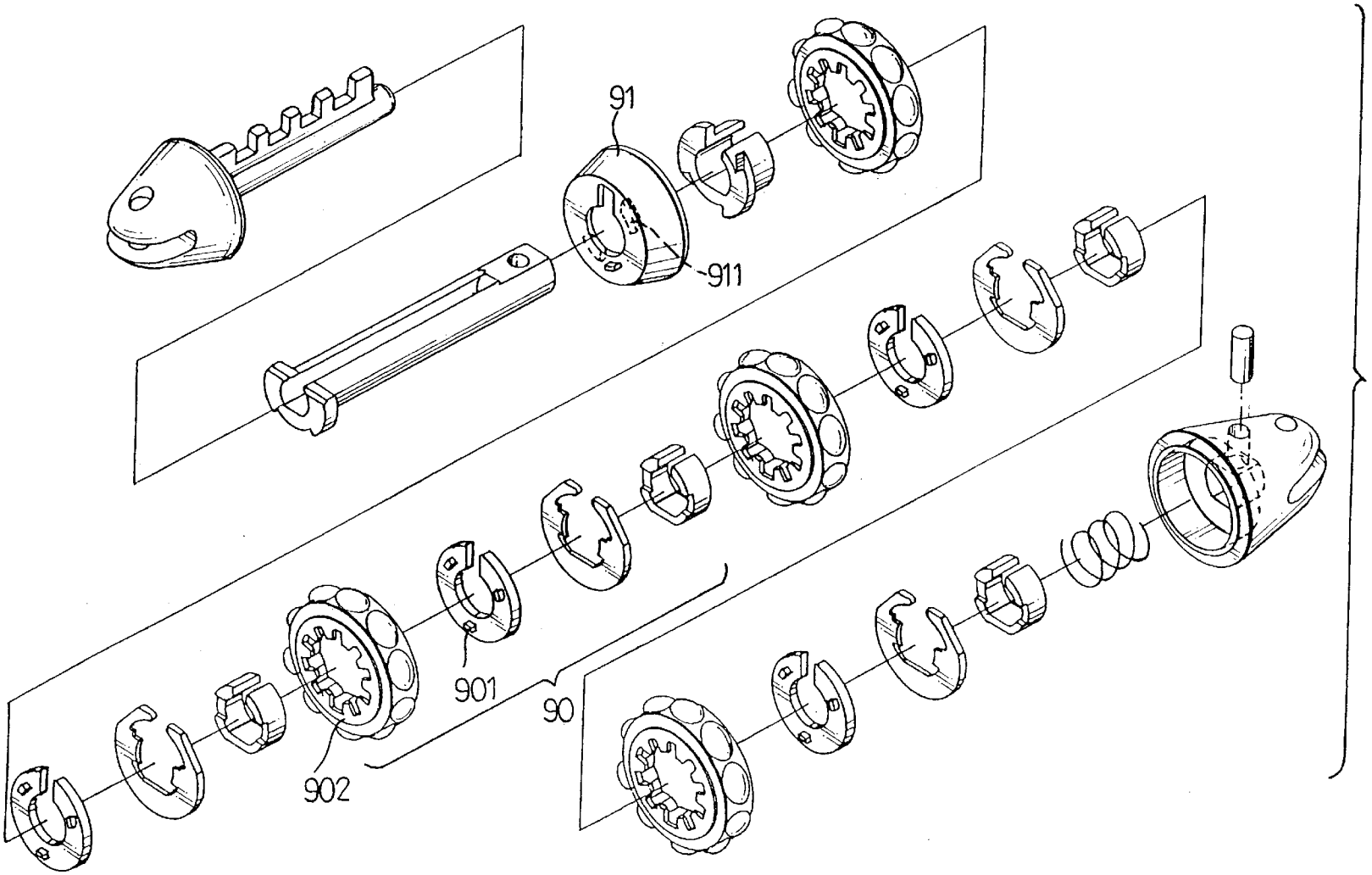
FIG. 9 PRIOR ART
FIG. 9 is an exploded perspective view showing an alternative conventional lock with a resettable combination.

A resetting operation of the original preset sequence may be performed when the rod 122 of the locking head 12 is separated from the tube 112 of the locating head 11. Referring to FIG. 4 and FIG. 5, before the resetting operation, the extension 43 of the toggle means 40 abuts the inclined surface 323 defined in a lower portion of the annular member 30 and the small-diameter-ends 414 of the cam gears 413 of the toggle means 40 abut the selector 20. In this case, the protrusion 224 of the locating block 22 is exactly received in a corresponding valley 213 of the rotatable ring 21, whereby the locating block 22 can be driven by the rotatable ring 21 to facilitate a locking operation as the above mentioned. Referring to FIG. 6 and FIG. 7, when in a resetting operation, the toggle means 40 is pivoted to make its extension 43 abut the inclined surface 323 defined in an upper portion of the, annular member 30, therefore the large-diameter ends 415 of the cam gears 413 will abut and push the selector 20 to separate the protrusion 224 from the corresponding valley 213. Since each of the set of selectors 20 are attached with each other, the separation of the protrusion 224 from the corresponding valley 213 in the first selector 20 will cause a sequent separation of the protrusion 224 in the rest of the set of the selectors 20. In this way, the locating blocks 21 of the set of selectors 20 will not be driven by the rotatable rings 21. Then the set of selectors 20 can be reset to a new sequence of symbols different to the original sequence by rotating the rotatable ring 21 to a sequence of desired symbols. After the resetting operation, the protrusions 224 of the locating blocks 22 return to be received in a corresponding valleys 213 of the rotatable rings 21 by turning the toggle means 40 to its original state as shown in FIG. 4 and FIG. 5. Therefore, the lock can be locked and unlocked under the control of the new sequence of symbols. It is to be appreciated that performance of the resetting operation of the lock of the present invention can be readily achieved.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A lock with a resettable combination comprising:

an extension means;

a locating head and a locking head respectively coupled with two different ends of the extension means, said locating head having a tube extending therefrom, said locking head having a rod extending therefrom and received within the tube;

a spring mounted around the tube of the locating head;

a set of selectors respectively and sequentially mounted around the tube of the locating head, each of said set of selectors indicating a series of symbols marked on an outer circumference thereof and having a rotatable ring, a locating block, a drive block and a torsion spring combined for selection; and a sequence reset means mounted around the tube of the locating head and adjacent to the set of selectors, said sequence reset means including:

an annular member defining a pair of opposed holes in a periphery thereof; and a toggle means pivotally engaged with the annular member for driving the set of selectors, said toggle means being configured as a semi-circular collar and having a pair of cam gears respectively formed on two distal ends defined therein, said pair of cam gears extending through the pair of opposed holes of the annular member to abut one of the selectors.

2. A lock with a resettable combination as claimed in claim 1, wherein said annular member integrally has an internal ring and an external ring, said internal ring having a pair of opposed internal lugs formed on a periphery thereof and said external ring having a pair of external lugs formed thereon to correspond to the pair of opposed internal lugs, said pair of opposed holes of the annular member being defined between the pair of internal lugs and the corresponding external lugs, each of said internal lugs defining a first aperture and each of the corresponding external lugs defining a second aperture to align with the first aperture, a pin sequentially extending through the second aperture, a bore defined in a corresponding cam gear, the first aperture and a hole defined in a periphery of the tube of the locating head to engage the annular member and the toggle means with the locating head.

3. A lock with a resettable combination as claimed in claim 1, wherein said annular member integrally has an internal ring and an external ring, said internal ring defining a gap and a recess respectively in an upper portion and a lower portion of a periphery thereof, said external ring having a pair of inclined surfaces respectively truncated at an upper portion and a lower portion in a periphery thereof; and said toggle means has a boss formed on an inner periphery thereof and an extension formed on an outer periphery thereof, said extension selectively abutting one of the pair of inclined surfaces of the annular member when the toggle means is pivoted with respect to the annular member.

4. A lock with a resettable combination as claimed in claim 3, wherein said extension has two bevel side faces formed thereon to facilitate operation by a user.

5. A lock with a resettable combination comprising:

an extension means;

a locating head and a locking head respectively coupled with two different ends of the extension means, said locating head having a tube extending therefrom, said locking head having a rod extending therefrom and receivably engaged with the tube;

a spring mounted around the tube of the locating head;

a set of selectors respectively and sequentially mounted around the tube of the locating head, each of said set of selectors indicating a series of symbols on an outer circumference and having a rotatable ring, a locating block, a drive block and a torsion spring combined for selection, said rotatable ring having a central hole defined therein and a plurality of valleys defined in a periphery defining the central hole, said locating block being received in the rotatable ring and having a collar flange extending therefrom, said collar flange defining a first gap at a top portion thereof and having a protrusion formed on a lower portion thereof to be received in a respective valley of the rotatable ring, said drive block having a central hole defined therein and a second gap defined in an upper portion of a periphery defining the central hole, said drive block further having a C-shaped buckle integrally extending therefrom, said C-shaped buckle defining a groove in a periphery thereof to receive a torsion spring; and a sequence reset means mounted around the tube of the locating head, said sequence reset means having an annular member and a toggle means pivotally engaged with the annular member for driving the set of selectors, said annular means defining a pair of opposed holes in a periphery thereof, said toggle means being configured as a semi-circular collar and having a pair of cam gears respectively formed on two distal ends defined therein, said pair of cam gears extending through the pair of opposed holes of the annular member to abut one of the selectors.

6. A lock with a resettable combination as claimed in claim 5, wherein said annular member integrally has an internal ring and an external ring, said internal ring having a pair of opposed internal lugs formed on a periphery thereof and said external ring having a pair of external lugs formed thereon to correspond to the pair of opposed internal lugs, said pair of opposed holes of the annular member being defined between the pair of internal lugs and the corresponding external lugs, each of said internal lugs defining a first aperture and each of the corresponding external lugs defining a second aperture to align with the first aperture, a pin sequentially extending through the second aperture, a bore defined in a corresponding cam gear, the first aperture and a hole defined in a periphery of the tube of the locating head to engage the annular member and the toggle means with the locating head.

7. A lock with a resettable combination as claimed in claim 5, wherein said annular member integrally has an internal ring and an external ring, said internal ring defining a gap and a recess respectively in an upper portion and a lower portion of a periphery thereof, said external ring having a pair of inclined surfaces respectively truncated at an upper portion and a lower portion in a periphery thereof, said toggle means has a boss formed on an inner periphery thereof and an extension formed on an outer periphery thereof, said extension selectively abutting one of the pair of inclined surfaces of the annular member when the toggle means is pivoted with respect to the annular member.

8. A lock with a resettable combination as claimed in claim 7, wherein said extension has two bevel side faces formed thereon to facilitate operation by a user.

9. A lock with a resettable combination as claimed in claim 5, wherein said torsion spring has two angled ends respectively gripping two distal ends defined in the buckle.

* * * * *